US005870058A

United States Patent [19]

Rothe

[11] Patent Number: 5,870,058

[45] Date of Patent: Feb. 9, 1999

[54] RECEIVER MODULE FOR RECEIVING EXTREMELY HIGH FREQUENCY ELECTROMAGNETIC DIRECTIONAL RADIATION FIELDS

[75] Inventor: Lutz Rothe, Halle, Germany

[73] Assignee: Dettling + Oberhausser Ingenieurgesellschaft, Germany

[21] Appl. No.: 849,440

[22] PCT Filed: Dec. 1, 1995

[86] PCT No.: PCT/EP95/04748

§ 371 Date: May 30, 1997

§ 102(e) Date: May 30, 1997

[87] PCT Pub. No.: WO96/17401

PCT Pub. Date: Jun. 6, 1996

[30] Foreign Application Priority Data

Dec. 2, 1994 [DE] Germany ..... 44 42 894.4

[51] Int. Cl.[6] ..... H01Q 1/38

[52] U.S. Cl. ..... 343/700 MS; 343/830

[58] Field of Search ..... 343/700 MS, 795, 343/790, 791, 830, 853

[56] References Cited

U.S. PATENT DOCUMENTS 5,181,042 1/1993 Kaise et al. ..... 343/700 MS 5,319,378 6/1994 Nalbandial et al. ..... 343/700 MS 5,475,394 12/1995 Kohls et al. ..... 343/700 MS 5,777,584 7/1998 Rothe ..... 343/700 MS

*Primary Examiner*—Don Wong

*Assistant Examiner*—Tan Ho

*Attorney, Agent, or Firm*—George Pappas

[57] ABSTRACT

The invention is based on a planar concept and involves the configuration of a planar radiating element with the property of generating wide-band electromagnetic radiation fields with circular field polarisation. A wide-band radiating element is developed in which the radiating and excitation network planes are separated and excitation of the radiating element is achieved using a coupling waveguide comprising a group of highly conductive planar elements stacked along the normal to their (large) surfaces above a conductive ground plane; to ensure a large radiation band-width, the highly conductive planar elements are placed well above the conductive ground plane and their highly inductive coupling components (which are connected to the ground plane) are compensated by special coaxial waveguide diaphragms whose ellipticity of the circular polarisation is adjusted solely by circular or square diaphragms within the planar contour, without affecting the radiating edges.

16 Claims, 3 Drawing Sheets

3-3

RECEIVER MODULE FOR RECEIVING EXTREMELY HIGH FREQUENCY ELECTROMAGNETIC DIRECTIONAL RADIATION FIELDS

TECHNICAL FIELD

The invention relates to a receiver module for receiving extremely high frequency electromagnetic directional radiation fields.

BACKGROUND OF THE INVENTION

Currently known planar radiating element solutions for receiving electromagnetic radiation fields are based on the electromagnetic excitation of monopole groups in microstrip execution as well as of radiating openings of rectangular, square, triangular, circular, rhombic or trapezoidal boundary or of a boundary superposed on the aforementioned elements, the feed of which occurs by means of microstrip waveguides running on open circuit.

The generation of the radiation fields occurs on this basis exclusively over galvanically excited monopoles or monopole groups or over monopoles or monopole group-excited diaphragm fields.

The reciprocal arrangement of the exciting monopoles and diaphragms as well as the particular design of the diaphragm contour determine in their combination the characteristic of the generatable electromagnetic radiation field.

Here the arrangements of the either radiating or feeding microstrip waveguides are based on the generation of circularly polarized electromagnetic radiation fields consisting in each case of a pair of open-circuited microstrip waveguides of the geometric length of a quarter wavelength with respect to the line wavelength as well as of a spatial and temporal displacement of 90 degrees, or on the generation of linearly polarized electromagnetic radiation fields by means of in-phase generated monopoles, the geometric arrangement of which determines the vibration direction of the electrical field vector.

Besides monopole executions of the microstrip waveguides, there are known dipole as well as polar resonator arrangements, in which open-circuit microstrip wave guides or monopole executions are used exclusively for the excitation of diaphragm fields. There are known, further, microstrip radiation elements in ring or frame execution with resonant geometric ring or frame length. The arrangement of spatially orthogonally displaced and excited quarter wavelength radiating elements or also orthogonally displaced half-wavelength radiating elements, in two excitation network planes activatable independently of one another in triplateau execution leads to polarization-switchable antenna arrangements. Further there are known polarization-switchable solutions on the basis of diode-switchable waveguide combinations, by means of which linearly polarized fields are superposed on circularly polarized fields or the polarization direction of the circular polarization of the radiation field are varied.

The known solutions of the excitation networks for the case of group arrangements are based on the parallel feeding of the radiating elements or on the parallel feeding of series-fed radiating element subgroups.

The coupling of the radiating element plane or of the radiating element planes with the corresponding converting component occurs over a waveguide transition with capacitive coupling-in of the radiating element sum signal, in which within the waveguide segments the main mode is excited, i.e. the mode of the highest boundary wavelength.

The known waveguide transitions here have a rectangular cross section and generate at the point of the capacitive coupling-in of the maximum of the electric field components directed parallel to the waveguide narrow side.

Disadvantages of the solution of the known state of the art are the restriction in the arrangement height of the radiating elements in consequence of the uncompensated inductive constituents of the complex input impedance of the radiating element, as well as the necessity of generating the circular field polarization exclusively with the means of the double-path excitation, phase displaced and spatially orthogonally to one another, or of the deviation from the square or circular contour of the radiating element. Further disadvantageous for the case of coaxial couplings-in is the necessary of the galvanic connection of the coaxial inner conductor with the planar element to be excited.

The known solutions for the state of the art, furthermore, allow no possibility of correcting, by means of externally insertable mechanical adjustment elements, the spectral or the polarization behavior of the structured radiating element.

SUMMARY OF THE INVENTION

The problem of the invention is the configuration of planary radiating elements with the property of generating wide-band directed electromagnetic radiation fields with circular field polarization. The aim of the invention is in particular to make available a wide-band radiating element, by means of which aimed information transmission intervals are conceivable primarily within the scope of the mobile telephone or information transmission sector. Further, there are to be made possible radio field connection or free space-supported transmission channels in the frequency ranges 8.20 GHz to 12.50 GHz, 11.90 GHz to 18.00 GHz as well as 49.80 GHz to 75.80 GHz, as well as for waveguide-supported transmission intervals to be substituted principally of the formulas R 1~00, R 140 or R 620. In order in this context to minimize free space conditioned depolarization influences and accompanying losses in polarization, a further aim of the invention is the defined generation of upward-directed radiation fields with circular polarization by means of planary radiating element components with a high damping of spurious radiation.

The area of use of the invention comprises preferably the fields of mobile telephone or information transmission, the sector of individual or special services that permit a communication of the corresponding subscribers within terrestrial networks as well as within short-distance transfer stretches in the range of the atmospheric damping maxima.

The field of application relates, further, to the whole sector of information transmission on the basis of defined point-to-point connections.

The problem of the invention is solved by the features of reception module for the reception of extremely high frequency electromagnetic directional radiation fields, consisting of a group of surface resonators which are excited by means of a coupling network, and coupled among one another, in which the coupling network leads to a central feed point of defined impedance characteristic, characterized in that an array of highly conductive surface elements (1) of defined geometry as well as of defined positioning condition is arranged on a dielectric carrier (2) in such manner that on the two oppositely lying parallel planes (3) of the dielectric carrier there arise congruent element groupings; the dielectric carrier (2) is arranged parallel to a closed highly conductive plane (4), so that the parallel planes run distance-homogeneously to one another; the surface elements (1) of the two parallel-running element planes have both agreeing contours and also agreeing outside measurements; the surface elements (1) are characterized by two like or unlike symmetry planes (5) and have in each case in one of the two symmetry planes (5) two circular diaphragms (6) or in each of the two symmetry planes (5) in each case two circular diaphragms (6), the circular diaphragms (6) with reference to planes being in each case at the same distance from the intersection point of the surface diagonals (7) for the case of rectangular surface elements,or from the starting point of the radius vectors (8) for the case of circular surface elements; the symmetry planes in which the diaphragms are arranged are with respect to planes disposed spatially orthogonally to one another; the electromagnetic excitation of the surface elements occurs by means of coaxial waveguide diaphragms (9), the axes of which run spatially parallel to the surface normal of the dielectric carrier (2); the coaxially waveguide diaphragms (9) are arranged in such manner that their axis in each case runs along a section plane (10) which forms an angle of 45° with respect to the section planes along which the axes of the circular diaphragms (6) run; the coaxial waveguide diaphragms (9) consist of a coaxial waveguide the outside conductor (11) of which forms the galvanic continuation of the closed highly conductive plane (4) and the inside conductor (12) of which issues axially into the circular diaphragm (13) of the plane (3) facing the parallel and highly conductive plane (4), the plane facing away from the highly conductive plane (4) not being galvanically contacted. There is made available a radiating element, the radiating-element and excitation network planes of which are disposed in separate planes, the excitation of which occurs by means of a coupling waveguide which consists of a group of highly conductive surface elements stocked along the surface normal, over a conductive ground plane, in which for the achievement of a high radiation bandwidth the highly conductive surface elements are arranged at a great height above the conductive ground plane, the ellipticity of the circular polarization of which is adjusted exclusively over circular or square diaphragms within the surface contour without influencing of the radiating edges, and excitation of which is to occur exclusively capacitively, in order on the assembling side in the coupling of radiating-element and excitation plane to exclude soldering, screw or rivet connections, and therewith to ensure a modular manner of production.

The invention is to be specified with the aid of the drawings and the examples of execution without restriction of the generality.

DESCRIPTION OF SPECIFIC EMBODIMENTS

Figure 1:
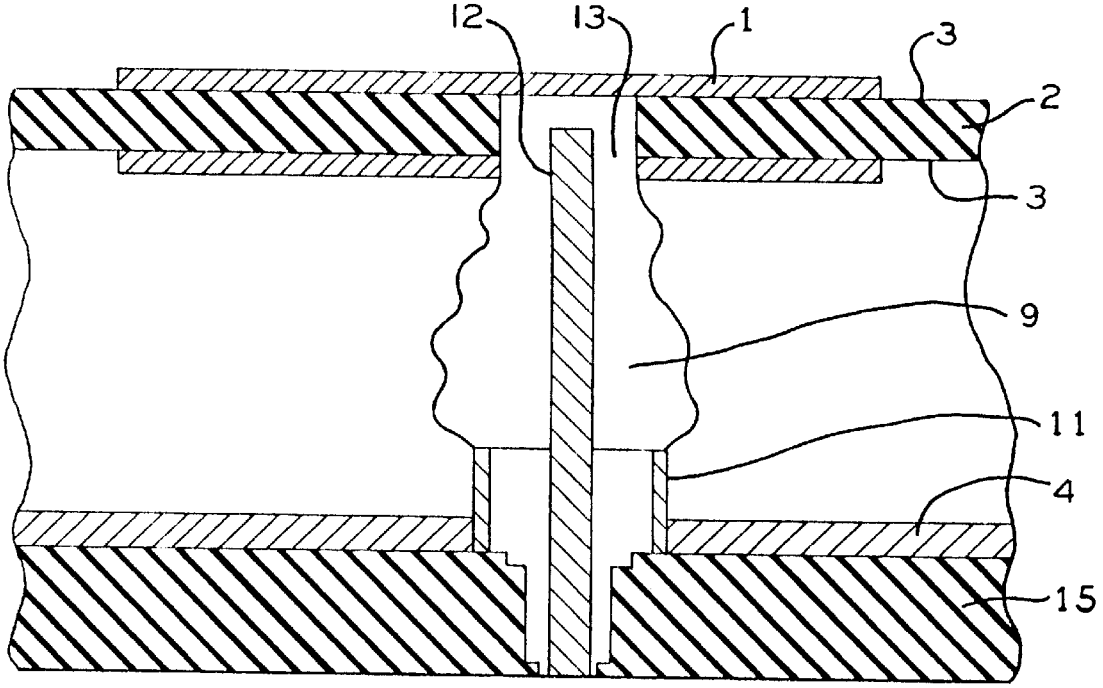
FIG. 1 Cross section through a part of the reception module according to the invention.

According to FIG. 1 in the invention on a dielectric carrier 2 there are arranged two highly conductive surface elements 1 of defined geometry in such manner that these are positioned on the two oppositely lying parallel planes 3 of the dielectric carrier congruently as well as with the same surface contour and size. Further, the dielectric carrier 2 is arranged parallel to a closed highly conductive plane 4, so that the two planes run distance-homogeneous to one another. Here the arrangement height of the dielectric carrier 2 with respect to the highly conductive plane 4 is chosen multiply greater than the height of the dielectric carrier 2 and, with respect to the free space wavelength of the signal to be transmitted, greater than the tenth part of the allocated free space wavelength.

Figure 2:
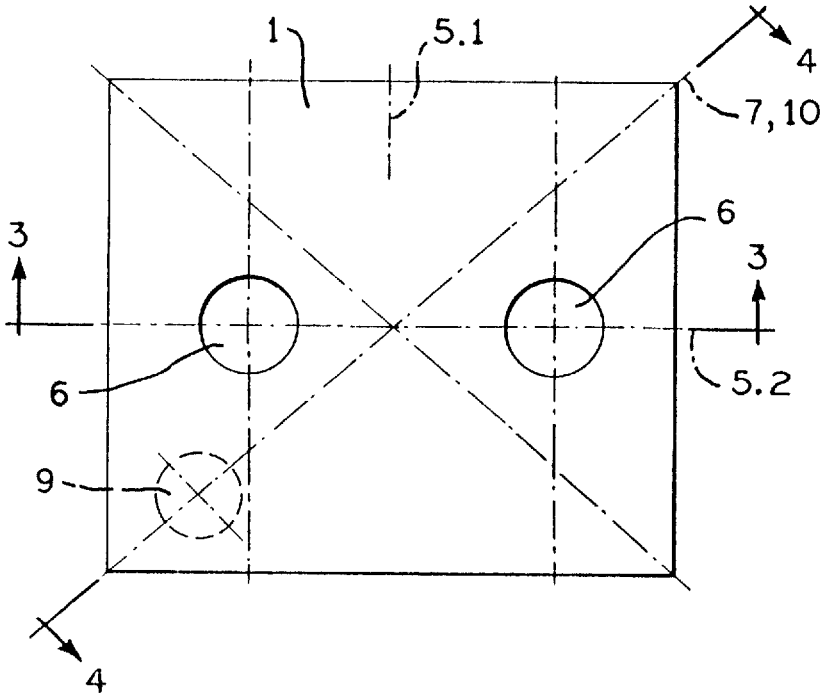
FIG. 2 Plan view of a surface element according to the invention on a dielectric carrier.
Figure 3:
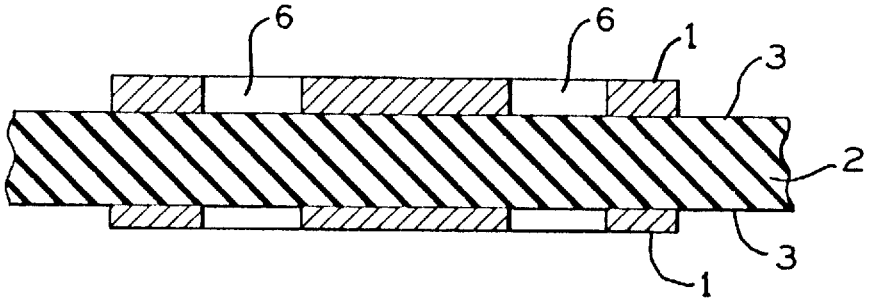
FIG. 3 Section A–A' through a part of a dielectric carrier reception module with congruent surface elements.
Figure 4:
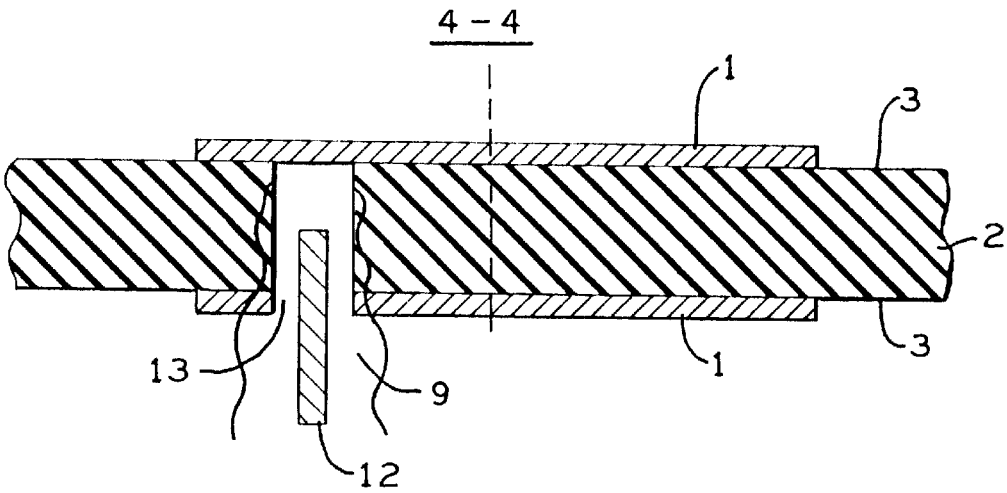
FIG. 4 Section B–B' through a part of a dielectric carrier of the reception module with congruent surface elements.

As is to be learned from FIGS. 2–4, the surface elements have present, in one of their two planes of symmetry 5.1, 5.2 two circular diaphragms 6, or in each of the two planes of symmetry 5.1, 5.2 in each case two circular diaphragms 6, in which system the circular diaphragms 6 are in respect to the planes in each case at the same distance from the intersection point of the surface diagonals 7 for the case of rectangular or square surface elements, or from the starting point of the radius vectors for the case of circular surface elements, and the circular diaphragms 6 of the first plane have the same circle center point as the corresponding circular diaphragms 6 of the second plane, but can have different diameters with respect to surface planes and/or with respect to planes of symmetry.

Here the circular diaphragms 6, by means of insertion of external dielectric cylindrical bodies of definably selectable susceptibility, can additionally be attuned with respect to their complex impedance profile, and with arbitrary timing.

The electromagnetic excitation of the surface elements occurs, as shown in FIG. 1 and FIG. 4, by means of coaxial waveguide diaphragms 9, as according to the invention the outside conductor 11 forms the galvanic continuation of the closed, highly conductive plane 4, and the inside conductor 12 issues axially into the circular diaphragm 13 of the plane 3 facing the parallel and highly conductive plane 4, the highly conductive plane facing the parallel and highly conductive plane 4 not being galvanically contacted. The coaxial waveguide diaphragms 9 are arranged in such manner that their axes in each case run along a section plane 10 which forms and angle of 45° with respect to the section plane, along which the axes of the circular diaphragms 6 run.

In this manner the salient inductive component of the coupling pin 12 is reduced by means of the coaxial outside conductor 11 introduced into the resonator space and therewith there is achieved a real input impedance of the radiating element at the point of transition of the coaxial waveguide diaphragm onto the planar excitation network.

In the following there is to be given an example for the configuration of a high-gain radiating element with reciprocal state switchability between left-turning or right-turning circular polarization of the electrical field vector.

Figure 5:
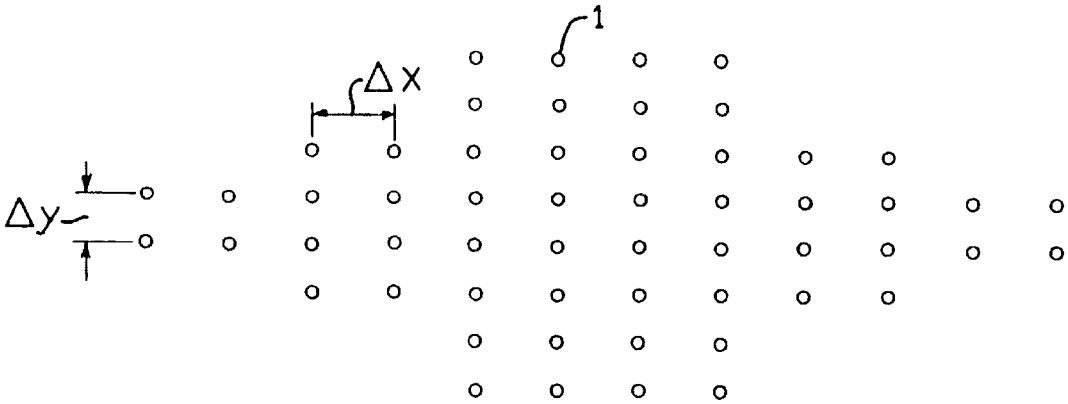
FIG. 5 Overall arrangement of a radiating element system with 64 radiating elements of identical geometric boundary.

Here a group of planar surface elements 1 with square boundary of the resonator surface is arranged on a dielectric carrier in such manner that there arises a distribution density of the planar radiating elements decreasing toward the outer edge of the group radiating elements, in which the total arrangement of the radiating element system is configured from a layered system of two plane-parallel radiating element planes with in each case 56 radiating elements of identical geometric boundary according to the element distribution represented in FIG. 5.

For FIG. 5 there holds the following:

The positioning spacings of the radiating elements per coordinate direction are chosen identical, the positioning spacings being referred in each case to the apex point of the surface resonators and ΔX representing the respective positioning spacing in the X-coordinate direction or in the horizontal plane and ΔY representing the respective positioning spacing in the Y-coordinate direction or in the vertical plane. The positioning spacing ΔX is measured here at the 0.95-fold value of the positioning spacing ΔY.

For the positioning spacing in the Y-coordinated direction there is used as basis the 0.9-fold value of the free space wavelength with respect to the band middle frequency of the signal spectrum to be transmitted.

The arranging of the surface elements occurs in each case, as shown in FIG. 1 and in FIGS. 3–4, on a dielectric carrier 2, consisting of a poly-4-methylhexene foil with a foil thickness of 75 microns. The two planes 3, consisting of the arrangements of the surface elements 1, structured, in each case, on a poly-4-methylhexene foil, are separated from one another by a polyethylene layer of the thickness of one twentieth of the free space wavelength of the transmitted signal. The surface element planes 3 are positioned distance-homogeneously over a highly conductive ground plane 4, consisting of highly pure aluminum with optical polish of the surface in an arrangement height of one eighth of the free space wavelength of the transmitted signal.

The arranging of the surface element pairs occurs in such manner that the intersection points of the surface diagonals 7 are always assigned on an identical axis parallel to the adjuster (Richter) of the surface normal. The surface elements 1, the surface of which is square—as represented in FIG. 2—are arranged in each case in the plane of horizontal symmetry line 5 as well as in the plane of the vertical symmetry line 5 with two circular diaphragms 6, symmetrically with respect to the intersection point of the surface diagonals 7 or of the horizontal and vertical symmetry lines 5, but with unequal diaphragm diameter with respect to the lines or planes of symmetry.

The excitation of the surface element pairs 1 occurs pointwise by means of a coaxially waveguide diaphragm 9 in which the outside conductor 11, as galvanic continuation of the closed and highly conductive ground plane 4, consisting of highly pure aluminum issues over a length of one-twelfth of the free space wavelength of the transmitted signal into the resonator space. The inside conductor 12 of the coaxial waveguide diaphragm 9 issues axially into the circular diaphragm 13 of the plane that is parallel to, and facing the highly conductive plane 4, and ends at an axial distance of one fortieth of the free space wavelength of the transmitted signal in front of the surface element 1 of the plane facing away from the highly conductive ground plane 4. The coaxial waveguide diaphragms 9 are arranged in such manner that their axes run in each case along the section plane 10 which forms and angle of 45° with respect to the section plane along which the circular diaphragms 6 run.

The resulting excitation network is arranged plane-parallel to the highly conductive ground plane 4 with use in common of the highly conductive ground plane and structured on a poly-4-methylhexene foil with a the foil thickness of 380 microns. The network-side coupling of the coaxial waveguide diaphragms 9 occurs through a waveguide system in microstrip technique, in which the excitation is organized over the formation of subgroups in such manner that the excitation network is formed over parallel-fed subgroups, the element feed of which occurs by means of series feeding. The planar excitation network is formed here from two subsystems which differ in respect to the resonator coupling in such manner that in each case a subsystem couples the coaxial waveguide diaphragms 9, which are position in each case identically on one of the two surface diagonals 7 of each surface element pair 1, while the second subsystem couples the complementary coaxial waveguide diaphragms 9.

The coupling of the excitation planes occurs over a ring hybrid which fulfills the condition, by means of the choice of the output signal path, to generate a phase difference of either +90° or −90° between the signal paths.

In summary it is possible to state that by the invention there is made available a reception module for the reception of extremely high frequency electromagnetic directional radiation fields on the basis of a planar solution conception, by means of which directed information transmission stretches are usable paramountly for the mobile telephone or information transmission sector.

The planar radiating element system is designed to ensure especially defined functional properties that make possible a substitution of waveguide-supported transmission stretches by means of radiation field-supported transmission paths in the frequency ranges 8.20 GHz to 12.50 GHz, 11.90 GHz to 18.00 GHz as well as 49.80 GHz to 75.80 GHz, in which here primarily there are to be fulfilled the conditions of the circular polarization as well as of the spurious radiation-reduced directional diagram. The invention is aimed at the entire sector of information transmission on the basis of defined point-to-point connections, as well as well as at the field of short-distance transmission in the spectral range of the atmospheric damping maxima.

I claim:

1. Reception module for the reception of extremely high frequency electromagnetic directional radiation fields, consisting of a group of surface resonators which are excited by means of a coupling network, and coupled among one another, in which the coupling network leads to a central feed point of defined impedance characteristic, characterized in that an array of highly conductive surface elements of defined geometry as well as of defined positioning condition is arranged on a dielectric carrier in such manner that on the two oppositely lying parallel planes of the dielectric carrier there arise congruent element groupings;

the dielectric carrier is arranged parallel to a closed highly conductive plane, so that the parallel planes run distance-homogeneously to one another;

the surface elements of the two parallel-running element planes have both agreeing contours and also agreeing outside measurements;

the surface elements are characterized by two like or unlike symmetry planes and have in each case in one of the two symmetry planes two circular diaphragms or in each of the two symmetry planes in each case two circular diaphragms, the circular diaphragms with reference to planes being in each case at the same distance from the intersection point of the surface diagonals for the case of rectangular surface elements, or from the starting point of the radius vectors for the case of circular surface elements;

the symmetry planes in which the diaphragms are arranged are with respect to planes disposed spatially orthogonally to one another;

the electromagnetic excitation of the surface elements occurs by means of coaxial waveguide diaphragms, the axes of which run spatially parallel to the surface normal of the dielectric carrier;

the coaxially waveguide diaphragms are arranged in such manner that their axis in each case runs along a section plane which forms an angle of 45° with respect to the section planes along which the axes of the circular diaphragms run;

the coaxial waveguide diaphragms consist of a coaxial waveguide the outside conductor of which forms the galvanic continuation of the closed highly conductive plane and the inside conductor of which issues axially into the circular diaphragm of the plane facing the parallel and highly conductive plane, the plane facing away from the highly conductive plane not being galvanically contacted.

2. Reception module for the reception of extremely high frequency electromagnetic directional radiation fields according to claim 1, characterized in that the coaxial waveguide diaphragms are fed by means of an excitation network, that is formed by means of a dielectric carrier which is arranged parallel to the closed highly conductive plane but on the radiator-side turned away from the highly conductive plane.

3. Reception module for the reception of extremely high frequency electromagnetic directional radiation fields according to claim 2, characterized in that an array of highly conductive surface elements of defined geometry as well as of defined positioning condition are arranged on two dielectric carriers, which has at its disposal a reference plane in common and separating the two dielectric layers, in such manner that congruent element groupings are present on the two oppositely lying layers, the parallel planes facing away from the common reference plane of the dielectric carrier.

4. Reception module for the reception of extremely high frequency electromagnetic directional radiation fields according to claim 2, characterized in that the highly conductive reference plane is arranged on the structure-carrying dielectric layer, is coupled galvanically with the closed highly conductive ground plane over the range of the entire array edge, and in that the surface normals of all the planes or layers have an identical direction.

5. Reception module for reception of extremely high frequency electromagnetic directional radiation fields according to claim 2, characterized in that the highly conductive plane which is inserted between the parallel and distance-homogeneously arranged structure-carrying dielectric layers has openings with a contour equivalent to one of the surface elements, in which the intersection points of the surface diagonals or the starting points of the radius vectors both of the surface elements and also of the opening within the highly conductive plane are identical and the inner-edge or radius vectors of the openings within the highly conductive plane have minimally the expansion of the free space wavelength with respect to the transmission-referenced signal middle frequency.

6. Reception module for reception of extremely high frequency electromagnetic directional radiation fields according to claim 2, characterized in that the element-internal diaphragms of the surface resonator arrays are plane-wise identical, but have different expansion in the arrangement of the planes to one another.

7. Reception module for the reception of extremely high frequency electromagnetic directional radiation fields according to claim 1, characterized in that an array of highly conductive surface elements of defined geometry as well as of defined positioning condition are arranged on two dielectric carriers, which has at its disposal a reference plane in common and separating the two dielectric layers, in such manner that congruent element groupings are present on the two oppositely lying layers, the parallel planes facing away from the common reference plane of the dielectric carrier.

8. Reception module for the reception of extremely high frequency electromagnetic directional radiation fields according to claim 7, characterized in that the highly conductive reference plane is arranged on the structure-carrying dielectric layer, is coupled galvanically with the closed highly conductive ground plane over the range of the entire array edge, and in that the surface normals of all the planes or layers have an identical direction.

9. Reception module for reception of extremely high frequency electromagnetic directional radiation fields according to claim 7, characterized in that the highly conductive plane which is inserted between the parallel and distance-homogeneously arranged structure-carrying dielectric layers has openings with a contour equivalent to one of the surface elements, in which the intersection points of the surface diagonals or the starting points of the radius vectors both of the surface elements and also of the opening within the highly conductive plane are identical and the inner-edge or radius vectors of the openings within the highly conductive plane have minimally the expansion of the free space wavelength with respect to the transmission-referenced signal middle frequency.

10. Reception module for reception of extremely high frequency electromagnetic directional radiation fields according to claim 7, characterized in that the element-internal diaphragms of the surface resonator arrays are plane-wise identical, but have different expansion in the arrangement of the planes to one another.

11. Reception module for the reception of extremely high frequency electromagnetic directional radiation fields according to claim 1, characterized in that the highly conductive reference plane is arranged on the structure-carrying dielectric layer, is coupled galvanically with the closed highly conductive ground plane over the range of the entire array edge, and in that the surface normals of all the planes or layers have an identical direction.

12. Reception module for reception of extremely high frequency electromagnetic directional radiation fields according to claim 11, characterized in that the highly conductive plane which is inserted between the parallel and distance-homogeneously arranged structure-carrying dielectric layers has openings with a contour equivalent to one of the surface elements, in which the intersection points of the surface diagonals or the starting points of the radius vectors both of the surface elements and also of the opening within the highly conductive plane are identical and the inner-edge or radius vectors of the openings within the highly conductive plane have minimally the expansion of the free space wavelength with respect to the transmission-referenced signal middle frequency.

13. Reception module for reception of extremely high frequency electromagnetic directional radiation fields according to claim 11, characterized in that the element-internal diaphragms of the surface resonator arrays are plane-wise identical, but have different expansion in the arrangement of the planes to one another.

14. Reception module for the reception of extremely high frequency electromagnetic directional radiation fields according to claim 1, characterized in that the highly conductive plane which is inserted between the parallel and distance-homogeneously arranged structure-carrying dielectric layers has openings with a contour equivalent to one of the surface elements, in which the intersection points of the surface diagonals or the starting points of the radius vectors both of the surface elements and also of the opening within the highly conductive plane are identical and the inner-edge or radius vectors of the openings within the highly conductive plane have minimally the expansion of the free space wavelength with respect to the transmission-referenced signal middle frequency.

15. Reception module for reception of extremely high frequency electromagnetic directional radiation fields according to claim 14, characterized in that the element-internal diaphragms of the surface resonator arrays are plane-wise identical, but have different expansion in the arrangement of the planes to one another.

16. Reception module for the reception of extremely high frequency electromagnetic directional radiation fields according to claim 1, characterized in that the element-internal diaphragms of the surface resonator arrays are plane-wise identical, but have different expansion in the arrangement of the planes to one another.

* * * * *